US008007163B2

(12) United States Patent
Chernoff

(10) Patent No.: US 8,007,163 B2
(45) Date of Patent: Aug. 30, 2011

(54) MECHANICAL FLUID MIXER SYSTEM

(76) Inventor: Larry J. Chernoff, Calgary (CA)

( * ) Notice: Subject to any disclaimer, the term of this patent is extended or adjusted under 35 U.S.C. 154(b) by 342 days.

(21) Appl. No.: 12/455,126

(22) Filed: May 28, 2009

(65) Prior Publication Data

US 2010/0300961 A1 Dec. 2, 2010

(51) Int. Cl.
*B01F 7/26* (2006.01)

(52) U.S. Cl. ..... 366/165.3; 366/168.2; 366/272; 415/60

(58) Field of Classification Search ..... 366/165.3, 366/168.2, 272; 415/60
See application file for complete search history.

(56) References Cited

U.S. PATENT DOCUMENTS

| | | | | |
|---|---|---|---|---|
| 829,396 | A * | 8/1906 | Gebhart | 415/60 |
| 3,152,792 | A * | 10/1964 | Goodwin | 366/288 |
| 3,179,382 | A * | 4/1965 | Knedlik | 366/272 |
| 3,558,282 | A * | 1/1971 | Evans | 422/134 |
| 7,942,567 | B2 * | 5/2011 | Ogawa | 366/77 |

* cited by examiner

*Primary Examiner* — David Sorkin

(57) ABSTRACT

A mixer body has an interior bore and an exterior surface. The exterior surface has first and third stages and an intermediate second stage. The mixer body forms a support ring. The second stage has threads. The third stage has holes. Pins are secured to the support ring. A turbine is rotatably coupled to each pin. The disk has arcuate ends and cut away sections. A cylinder has first and third stages and an intermediate second stage. The cylinder has an input end with a large opening for receiving a pipe. The cylinder has an output end with a discharge opening. The second stage of the cylinder has threads coupled to the mixer body. The third stage of the cylinder supports the turbines and the disk. When the mixing body and cylinder are threaded together, they form a chamber.

4 Claims, 4 Drawing Sheets

FIG 3
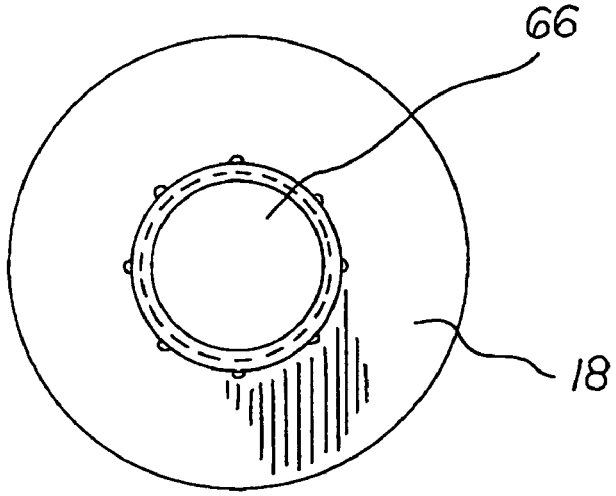
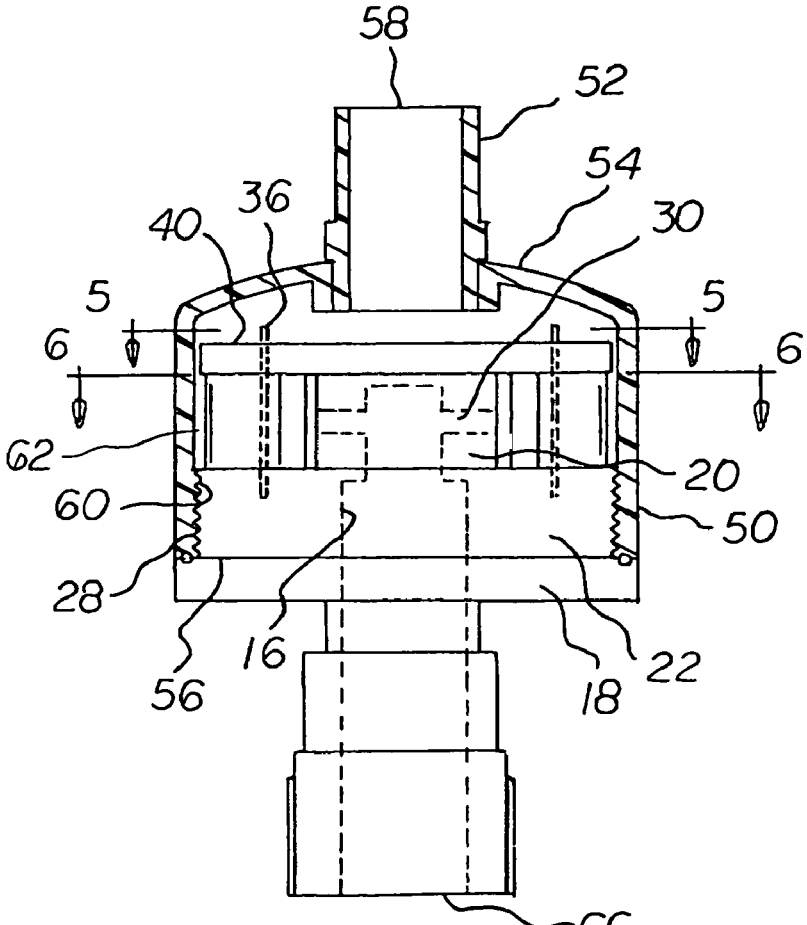
FIG 4

FIG 5
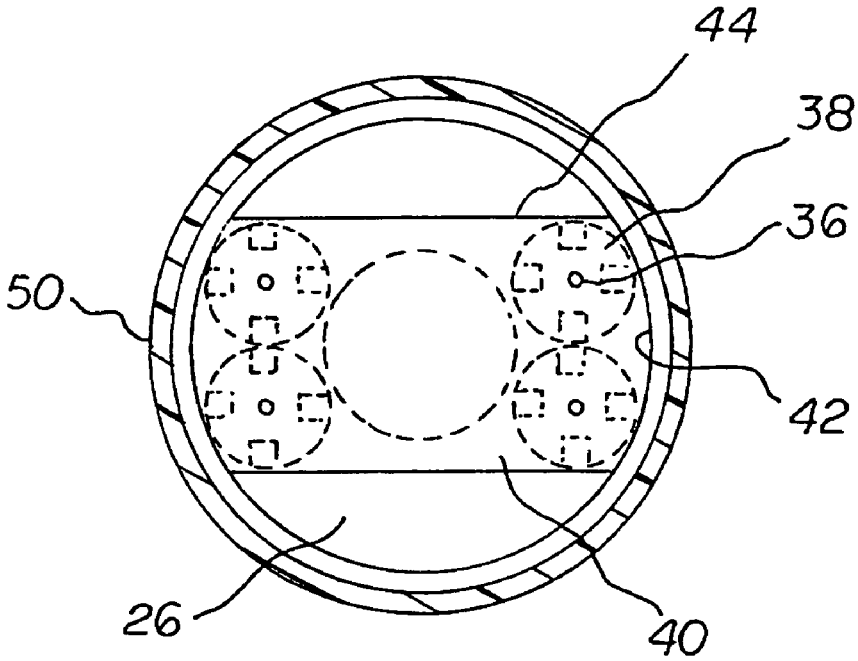
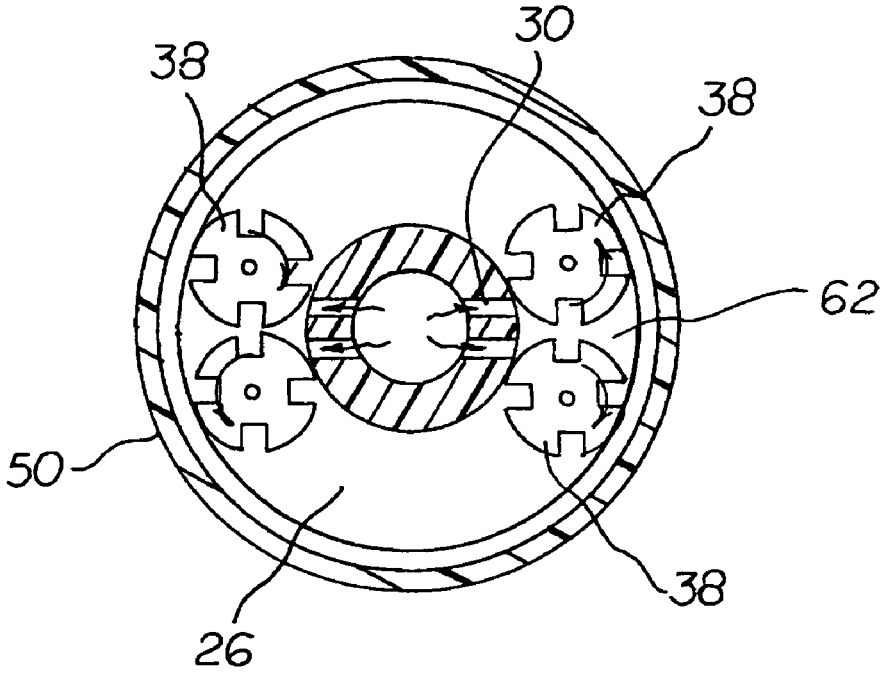
FIG 6

MECHANICAL FLUID MIXER SYSTEM

BACKGROUND OF THE INVENTION

Field of the Invention

The present invention relates to a mechanical fluid mixer system and more particularly pertains to in-line mixing of fluids to precipitate and separate particles, particularly iron, from untreated water, in a safe, convenient and economical manner.

SUMMARY OF THE INVENTION

In view of the disadvantages inherent in the known types of mixing systems of known designs and configurations now present in the prior art, the present invention provides an improved mechanical fluid mixer system. As such, the general purpose of the present invention, which will be described subsequently in greater detail, is to provide a new and improved mechanical fluid mixer system and method which has all the advantages of the prior art and none of the disadvantages.

To attain this, the present invention essentially comprises a mechanical fluid mixer system. First provided is a generally cylindrical mixer body. The mixer body has an interior surface. The mixer body has a bore. The bore provides for the passage of a flow of water to be mixed. The mixer body has a stepped exterior surface. The stepped exterior surface has an upstream first stage. The stepped exterior surface has a downstream third stage. The stepped exterior surface also has an intermediate second stage. The intermediate second stage is provided between the first and third stages. The mixer body forms an annular sealing ring. The sealing ring is provided with an elastomeric O-ring between the first and second stages. The mixer body forms an annular support ring. The support ring is provided between the second and third stages. The second stage has external screw threads. The third stage has generally radial holes. The holes couple the bore with exterior of the mixer body.

A turbine assembly is provided. The turbine assembly includes four pins. The pins are secured to the support ring in pairs. Each pair of pins is secured adjacent to oppositely spaced radial holes of the third stage of the mixer body. The turbine assembly includes a turbine. The turbine has a cross shaped cross section. The turbine is rotatably coupled to each pin. The turbine assembly includes a disk. The disk is attached to the pins. In this manner the turbines are rotatable between the support ring and the disk. The disk has arcuate ends. The disk has a radius of curvature the same as the second stage. The disk has parallel cut away sections. The cut away sections are provided between the arcuate ends.

Provided next is a cylinder. The cylinder has an upstream first stage. The cylinder has a downstream third stage. The cylinder has an intermediate second stage. The intermediate second stage is provided between the first and third stages. The cylinder has an input end. The input end has a large opening. The large opening receives a pipe. The cylinder has an output end. The output end has a small discharge opening. The second stage of the cylinder has internal screw threads. The internal screw threads are removably coupled to the internal screw threads of the mixer body. The third stage of the cylinder has a chamber. The chamber is adapted to receive water passing from the bore and radial holes of the mixer body, into contact with the turbines for the rotation of the turbines, passing beyond the cut away sections of the disk and into the chamber then out of the small opening.

Further provided is an input coupling component. In this manner a flow of untreated water is directed into the bore of the mixer body at the downstream third stage of the mixer body.

Provided last are output coupling threads. In this manner a flow of water is received from the chamber through the pipe connected to the mixer body after being mixed by the turbines with particles of the untreated water being precipitated and separated from the flow of water.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mechanical fluid mixer system which has all of the advantages of the prior art mixing systems of known designs and configurations and none of the disadvantages.

It is another object of the present invention to provide a new and improved mechanical fluid mixer system which may be easily and efficiently manufactured and marketed.

It is further object of the present invention to provide a new and improved mechanical fluid mixer system which is of durable and reliable constructions.

An even further object of the present invention is to provide a new and improved mechanical fluid mixer system which is susceptible of a low cost of manufacture with regard to both materials and labor, and which accordingly is then susceptible of low prices of sale to the consuming public, thereby making such mechanical fluid mixer system economically available to the buying public.

Even still another object of the present invention is to provide a mechanical fluid mixer system for in-line mixing of fluids to precipitate and separate particles, particularly iron, from untreated water, in a safe, convenient and economical manner.

Lastly, it is an object of the present invention to provide a new and improved mechanical fluid mixer system. A mixer body has an interior bore and an exterior surface. The exterior surface has first and third stages and an intermediate second stage. The mixer body forms a support ring. The second stage has threads. The third stage has radial holes. Pins are secured to the support ring. A turbine is rotatably coupled to each pin. The disk has arcuate ends and cut away sections. A cylinder has first and third stages and an intermediate second stage. The cylinder has an input end with a large opening for receiving a pipe. The cylinder has an output end with a discharge opening. The second stage of the cylinder has threads coupled to the mixer body. When the mixer body and cylinder are threaded together, they form a chamber.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom view of the system taken along line 3-3 of FIG. 1.

FIG. 4 is a cross sectional view taken along line 4-4 of FIG. 1.

FIG. 5 is a cross sectional view taken alone line 5-5 of FIG. 4.

FIG. 6 is a cross sectional view taken along line 6-6 of FIG. 4.

The same reference numerals refer to the same parts throughout the various Figures illustrating the primary embodiment of the invention.

DESCRIPTION OF THE PREFERRED EMBODIMENT

Figure 1:
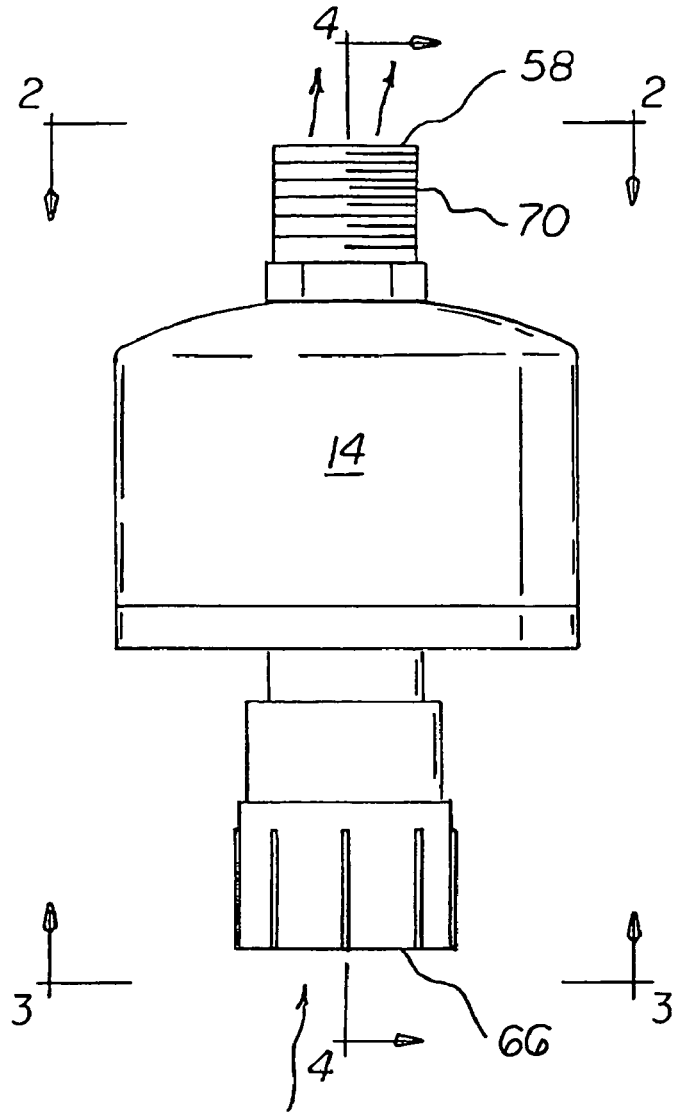
FIG. 1 is a front elevational view of a mechanical fluid mixer system constructed in accordance with the principles of the present invention.
Figure 2:
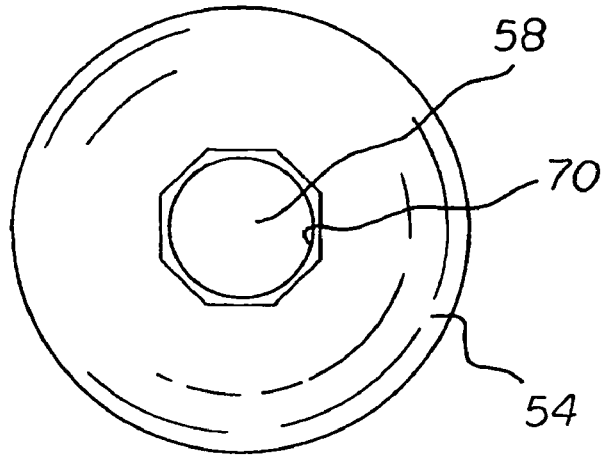
FIG. 2 is a plan view of the system taken along line 2-2 of FIG. 1.
Figure 7:
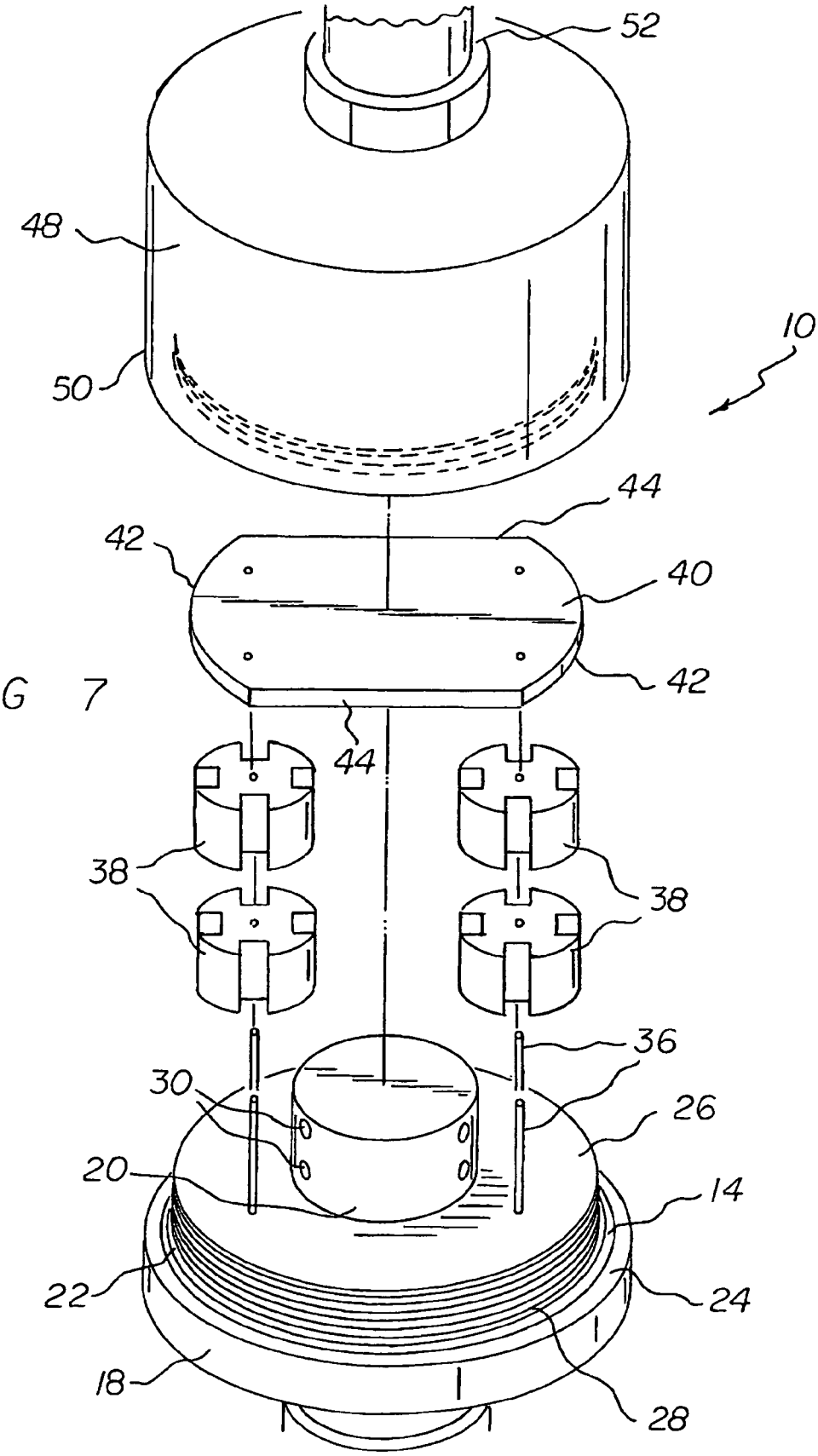
FIG. 7 is an exploded perspective illustration of the system shown in the prior figures.

With reference now to the drawings, and in particular to FIG. 7 thereof, the preferred embodiment of the new and improved mechanical fluid mixer system embodying the principles and concepts of the present invention and generally designated by the reference numeral 10 will be described.

The present invention, the mechanical fluid mixer system 10 is comprised of a plurality of components. Such components in their broadest context include a mixer body, a turbine assembly and a cap. Such components are individually configured and correlated with respect to each other so as to attain the desired objective.

First provided is a generally cylindrical mixer body 14. The mixer body has an interior surface. The mixer body has a bore 16. The bore provides for the passage of a flow of water to be mixed. The mixer body has a stepped exterior surface. The stepped exterior surface has an upstream first stage 18. The stepped exterior surface has a downstream third stage 20. The stepped exterior surface also has an intermediate second stage 22. The intermediate second stage is provided between the first and third stages. The mixer body forms an annular sealing ring 24. The sealing ring is provided with an elastomeric O-ring between the first and second stages. The mixer body forms an annular support ring 26. The support ring is provided between the second and third stages. The second stage has external screw threads 28. The third stage has generally radial holes 30. The radial holes couple the bore with exterior of the mixer body.

A turbine assembly is provided. The turbine assembly includes four pins 36. The pins are secured to the support ring in pairs. Each pair of pins is secured adjacent to oppositely spaced radial holes of the third stage of the mixer body. The turbine assembly includes turbine 38. Each turbine has a cross shaped cross section. A turbine is rotatably coupled to each pin. The turbine assembly includes a disk 40. The disk is attached to the pins. In this manner the turbines are rotatable between the support ring and the disk. The disk has arcuate ends 42. The disk has a radius of curvature the same as the second stage. The disk has parallel cut away sections 44. The cut away sections are provided between the arcuate ends.

Provided next is a cylinder 48. The cylinder has an upstream first stage 50. The cylinder has a downstream third stage 52. The cylinder has an intermediate second stage 54. The intermediate second stage is provided between the first and third stages. The cylinder has an input end. The input end has a large opening 56. The large opening receives a pipe. The cylinder has an output end. The output end has a small discharge opening 58. The second stage of the cylinder has internal screw threads 60. The internal screw threads are removably coupled to the internal screw threads of the mixer body. The second stage of the cylinder circumferentially surrounds the second and third stages of the mixer body and the turbines and the disk. The third stage of the cylinder has a chamber 62. The chamber is adapted to receive water passing from the bore and radial holes of the mixer body, into contact with the turbines for the rotation of the turbines, passing beyond the cut away sections of the disk and into the chamber then out of the small opening.

Further provided is an input coupling component 66. In this manner a flow of untreated water is directed into the bore of the mixer body at the downstream third stage of the mixer body.

Provided last are output coupling threads 70. In this manner a flow of water is received from the chamber through the pipe connected to the cap after being mixed by the turbines with particles of the untreated water being precipitated and separated from the flow of water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fluid mixer system comprising;

a mixer body having an interior bore and an exterior surface, the exterior surface having first and third stages with an intermediate second stage, the mixer body forming a support ring between the second and third stages, the second stage being formed with threads, the third stage being formed with holes;

a turbine assembly including pins secured to the support ring adjacent to the holes, a turbine rotatably coupled to each pin with a disk attached to the pins, the disk having arcuate ends and cut away sections; and a cylinder having first and third stages with an intermediate second stage, the cylinder having an input end with a large opening for receiving a pipe and an output end with a discharge opening, the second stage of the cylinder having threads coupled to the threads of the mixer body, the second stage of the cylinder surrounding the second and third stages of the mixer body and the turbines and the disk thus forming a chamber.

2. The system as set forth in claim 1 and further including:

an input coupling component for directing a flow of untreated water into the bore of the mixer body at the downstream third stage of the mixer body; and output coupling threads for a component receiving a flow of water from the chamber through the pipe connected to the cap.

3. The system as set forth in claim 1 wherein water received into the mixer body flows from the bore and holes of the mixer body, then into contact with the turbines for the rotation of the turbines, then passes beyond the cut away sections of the disk and into the chamber and then out of the discharge opening, after being mixed by the turbines with particles of the untreated water being precipitated and separated from the flow of water.

4. A fluid mixer system for in-line mixing of fluids to precipitate and separate particles, particularly iron, from untreated water, in a safe, convenient and economical manner, the system comprising, in combination;

a generally cylindrical mixer body having an interior surface with a bore for the passage of a flow of water to be mixed and a stepped exterior surface, the stepped exterior surface having an upstream first stage and a downstream third stage with an intermediate second stage between the first and third stages, the mixer body forming an annular sealing ring with an elastomeric O-ring between the first and second stages, the mixer body forming an annular support ring between the second and third stages, the second stage being formed with external screw threads, the third stage being formed with generally radial holes coupling the bore with exterior of the mixer body;

a turbine assembly including four pins secured to the support ring in pairs, each pair of pins being secured adjacent to oppositely spaced radial holes of the third stage of the mixer body, a turbine with a cross shaped cross section rotatably coupled to each pin with a disk attached to the pins whereby the turbines are rotatable between the support ring and the disk, the disk having arcuate ends with a radius of curvature the same as the second stage with parallel cut away sections between the arcuate ends;

a cylinder having an upstream first stage and a downstream third stage with an intermediate second stage between the first and third stages, the cylinder having an input end with a large opening for receiving a pipe and an output end with a small discharge opening, the second stage of the cylinder having internal screw threads removably coupled to the internal screw threads of the mixer body, the second stage of the cylinder circumferentially surrounding the second and third stages of the mixer body and the turbines and the disk, the third stage of the cylinder forming a chamber adapted to receive water passing from the bore and radial holes of the mixer body, into contact with the turbines for the rotation of the turbines, passing beyond the cut away sections of the disk and into the chamber then out of the small opening;

an input coupling component for directing a flow of untreated water into the bore of the mixer body at the downstream third stage of the mixer body; and output coupling threads for a component receiving a flow of water from the chamber through the pipe connected to the cap after being mixed by the turbines with particles of the untreated water being precipitated and separated from the flow of water.

* * * * *